US008191707B2

(12) United States Patent
McDonald et al.

(10) Patent No.: US 8,191,707 B2
(45) Date of Patent: Jun. 5, 2012

(54) CURTAIN ROD PACKAGE

(75) Inventors: Brian James McDonald, Roswell, GA (US); Tongchai Saesim, Bangkok (TH)

(73) Assignee: Newell Window Furnishings, Inc., High Point, NC (US)

( * ) Notice: Subject to any disclaimer, the term of this patent is extended or adjusted under 35 U.S.C. 154(b) by 0 days.

(21) Appl. No.: 12/915,627

(22) Filed: Oct. 29, 2010

(65) Prior Publication Data

US 2012/0103982 A1 May 3, 2012

(51) Int. Cl.
*B65D 85/02* (2006.01)
*B65D 25/54* (2006.01)

(52) U.S. Cl. ..... 206/326; 206/443; 206/769; 206/775; 229/162.6

(58) Field of Classification Search ..... 206/321, 206/326, 349, 443, 446, 525, 769, 775–778, 206/781, 782, 784; 229/162.1–162.7
See application file for complete search history.

(56) References Cited

U.S. PATENT DOCUMENTS

| | | | | | |
|---|---|---|---|---|---|
| 2,170,906 | A * | 8/1939 | Mertz | 206/777 |
| 2,285,600 | A * | 6/1942 | Maves | 206/326 |
| 2,795,325 | A * | 6/1957 | Smith | 206/349 |
| 3,184,052 | A * | 5/1965 | Gledhill | 206/226 |
| 3,249,213 | A * | 5/1966 | Palmer | 229/162.6 |
| 5,394,985 | A * | 3/1995 | Van Hest | 206/418 |
| 5,682,998 | A * | 11/1997 | McCoy et al. | 206/592 |
| 5,823,339 | A * | 10/1998 | Dunham et al. | 206/349 |
| 5,941,384 | A * | 8/1999 | Schonhardt et al. | 206/782 |
| 6,105,759 | A * | 8/2000 | Fuchs et al. | 206/784 |
| 6,247,589 | B1 * | 6/2001 | Schonhardt et al. | 206/782 |
| 6,575,302 | B2 * | 6/2003 | Robley, Jr. | 206/776 |

* cited by examiner

*Primary Examiner* — Bryon Gehman
(74) *Attorney, Agent, or Firm* — Esther F. Queen; Moore & Van Allen, PLLC

(57) ABSTRACT

A package and a method of assembling a package are provided. The package includes: a front wall connected to the rear wall by a first side wall and a second side wall; a first end portion and a second end portion disposed at opposite ends of the rear wall, front wall, first side wall, and second side wall; an elongated member; and at least one bracket for holding the elongated member by a clamping effect. A blank is also provided. The blank includes a plurality of panels foldably connected to one another and a bracket connected to one of the panels.

22 Claims, 13 Drawing Sheets

CURTAIN ROD PACKAGE

The invention relates generally to packaging and more particularly to packaging for elongated articles such as curtain rods.

BACKGROUND

Packaging for consumer goods, such as window hardware, often contain a large number of packaging components. A typical package, for example, may contain as many as fifteen different components such as foam, cardboard, and plastic materials. Such packages produce an excessive amount of waste and can have a negative impact on the environment. In addition, packages with a large number of components can be difficult to open and the contents of the packages can be difficult to retrieve.

SUMMARY

A package is provided. The package includes: a front wall connected to the rear wall by a first side wall and a second side wall; a first end portion and a second end portion disposed at opposite ends of the rear wall, front wall, first side wall, and second side wall; an elongated member; and at least one bracket for holding the elongated member by a clamping effect. In some embodiments of the package, the elongated member includes a first member, a second member, and a connecting member. In some embodiments of the package, the clamping effect includes positioning the bracket between the first member and the second member and tightening the first member to the second member via the connecting member.

The bracket includes a clamping portion having a bracket slot formed therein. In some embodiments of the package, the clamping effect includes positioning the connecting member within the bracket slot. In some embodiments of the package, the bracket further includes a front face and a rear face, where the clamping effect includes abutting the first member to the rear face and the abutting the second member to the front face.

In some embodiments of the package, the bracket includes an outer rim extending along the perimeter of the first face. In some embodiments of the package, the rear wall includes an outer rear panel and inner rear panel. The bracket further includes: a first plate disposed beneath the clamping portion; a second plate disposed beneath the first plate; and a linking portion positioned between the first plate and the second plate; where the linking portion is positioned within a bracket groove formed in the inner rear panel and where each of the first plate and second plate are positioned substantially parallel and adjacent to the inner rear panel.

The package further includes a foldable wall portion, the wall portion includes: a lower wall panel connected to and substantially perpendicular a portion of the front panel; a middle wall panel connected to and substantially perpendicular to the lower wall panel; and an upper wall panel connected to the middle wall panel and substantially parallel to the lower wall panel. In some embodiments of the package, at least a portion of the middle wall panel, the lower wall panel, and the upper wall panel have an opening formed therein. In some embodiments of the package, at least a portion of the lower wall panel and upper wall panel have an opening formed therein, and the middle wall panel is positioned on one side of the opening.

In some embodiments of the package, a portion of the first side wall, the front wall, and the second side wall have a window cutout portion formed therein, where the foldable wall portion is disposed at the window cutout portion. In some embodiments of the package, the first side wall includes an insert panel. The package further includes an insert, where the insert is received in an insert groove formed in the insert panel. In some embodiments of the package, the first side wall has a window formed therein.

The package further includes a partial cutout formed in a portion of the second side wall and a portion of the rear wall, the partial cutout comprising a first wall and a second wall; where the first wall is substantially perpendicular to the second side wall and the second wall is substantially perpendicular to the rear wall, and where the first wall and the second wall define a substantially square opening. In some embodiments of the package, a third member of the elongated member is positioned within the square opening.

A method of assembling a package is provided. The method comprising: providing a rear wall; providing a front wall foldably connected to the rear wall by a first side wall and a second side wall; providing a first end portion and a second end portion disposed at opposite ends of the rear wall, front wall, first side wall, and second side wall; providing an elongated member; and providing at least one bracket for holding the elongated member by a clamping effect.

In some embodiments of the method, the rear wall includes an inner rear panel and an outer rear panel. The method further comprising positioning the bracket into a bracket groove formed in the inner rear panel. In some embodiments of the method, the first side wall includes an insert panel. The method further comprising providing an insert and positioning the insert into insert grooves formed in the insert panel.

DETAILED DESCRIPTION OF EMBODIMENTS OF THE INVENTION

Figure 1:
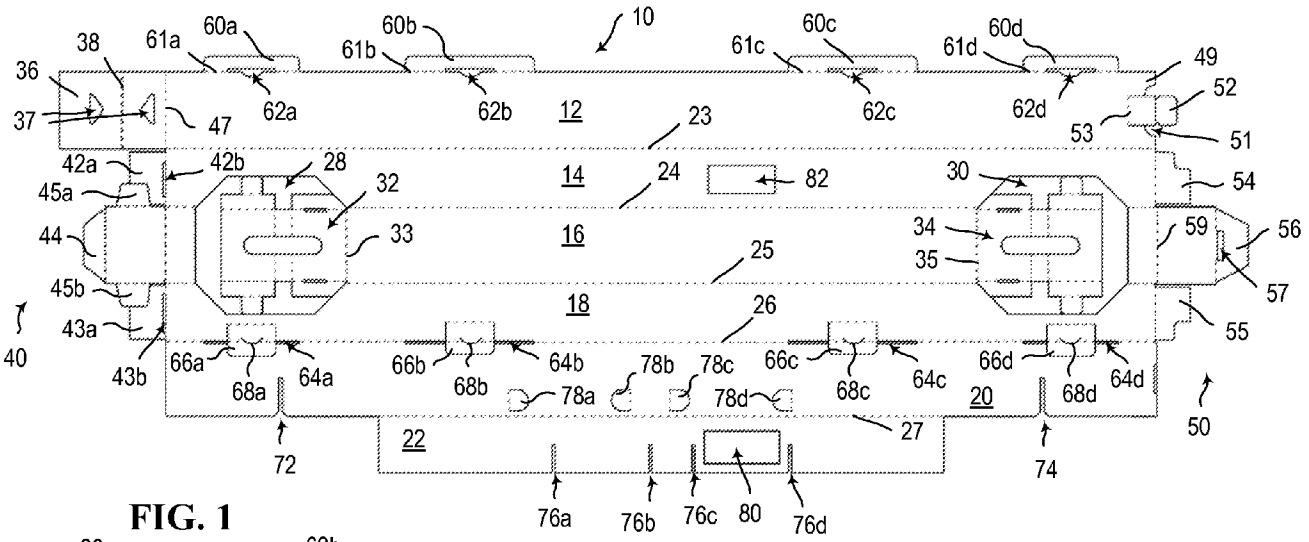
FIG. 1 is a plan view showing an embodiment of a package blank.
Figure 2:
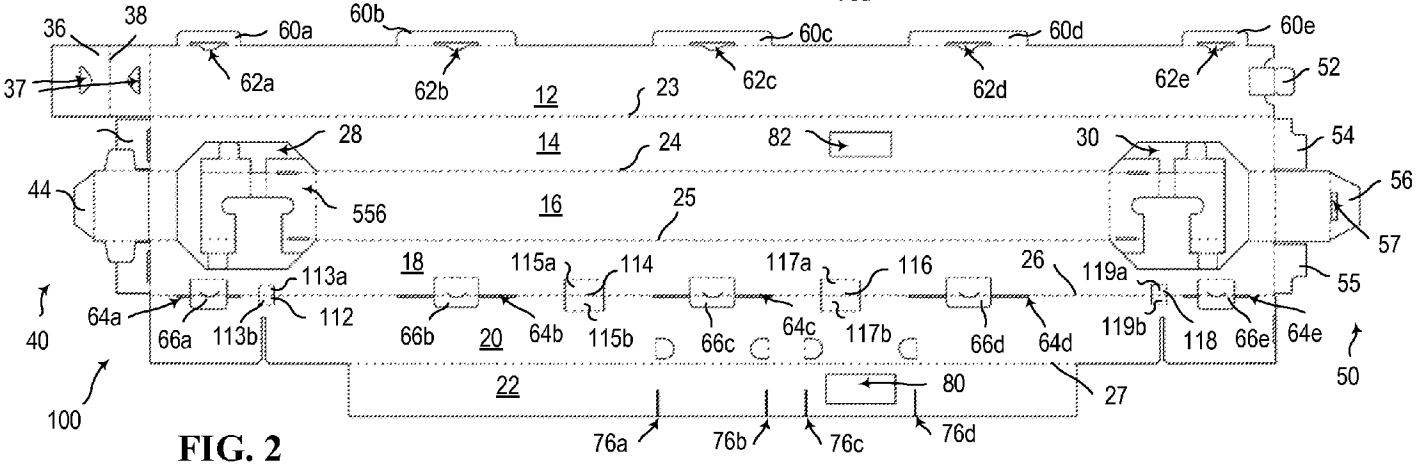
FIG. 2 is a plan view showing another embodiment of a package blank.

Referring to the FIGS. 1 and 2, example embodiments of packages and blanks are shown. It will be understood that the package and blank for forming a package as described herein can be formed from any suitable material such as paperboard, cardboard, fiberboard, plastic, or combinations thereof. Suitable substrates for forming the package include vertical or horizontal corrugated paperboard, one-sided white paperboard, semi-rigid plastic, or combinations thereof. The materials may also be surface treated with waxes, polymers, optical brightening agents, inks, dies, paint, or any other composition or surface treatment technique. The package and blank can be formed by any method generally known in the art for forming package and blanks such as die cutting.

Embodiments of an assembled package for an elongated member are provided in FIGS. 17-27. In FIGS. 17 through 21, views of an exemplary assembled package are illustrated at 600. And, FIGS. 23 through 27 illustrate an exemplary assembled package 645. The assembled packages 600 and 645 include a front wall 610, a rear wall 612 (see also, FIGS. 22 and 28), a first side wall 614, and a second side wall 616. The front wall 610 includes a front panel 16 and the rear wall includes an outer rear panel 12 and inner rear panel 20 (see also, FIGS. 22 and 28). The first side wall 614 includes a first side panel 14 and an insert panel 22. And, the second side wall 616 includes a second side panel 18. The front wall 610 and rear wall 616 are connected by the side walls 614 and 616. Positioned at opposite end portions of the walls 610, 612, 614, and 616 are a top end 618 and a bottom end 620.

Also included in the packages 610 and 645 is a first bracket 400 and another second identical bracket 400 for securing opposite ends of an elongated member 450. An article viewing window 623 is formed in portions of the walls 610, 614, and 616 to allow physical and visual access to the article stored in the packages 610 and 645. At least one isolating member 624 isolates the article in the article viewing window area from the remainder of the package and also helps to secure the elongated member 450 or portions thereof. The isolating member 624 includes one or more foldable wall portions 32, 532, 556, and 580, which are described in more detail below with regard to FIGS. 11-16. The packages 610 and 645 further include an auxiliary window 626. The window 626 includes a first side cutout 82 and a second side cutout 80 (see, FIGS. 1-2). The package 645 differs from the package 600 as it includes partial cutouts 112, 114, 116, and 118, discussed in more detail below and also includes an additional side tab 60*e*, additional side slot 62*e*, additional inner tab 66*e*, and additional slit 66*e* as will hereafter be described (see, FIG. 2).

In FIG. 1, a blank 10 suitable for forming the package shown in FIGS. 17-21 is shown. The blank 10 includes the outer rear panel 12, the first side panel 14, the front panel 16, the second side panel 18, the inner rear panel 20, and an insert panel 22. The outer rear panel 12 is foldably connected to the first side panel 14 along a fold line 23 and the first side panel 14 is foldably connected to the front panel 16 along a fold line 24. Similarly, the second side panel 18 is foldably connected to front panel 16 along a fold line 25, the inner rear panel 20 is foldably connected to the second side panel 18 along a fold line 26, and the insert panel 22 is foldably connected to the inner rear panel 20 along a fold line 27.

One or more window cutout portions 28 and 30 are formed in at least a portion of the first side panel 14, the front panel 16, and the second side panel 18 to create viewing window 623. It will be understood that the package and blank 10 may include any number of cutout portions and the cutout portions may be formed in any shape and in any desired location. Foldable wall portions 32 and 34 are positioned within the cutout portions 28 and 30 respectively. The wall portions 32 and 34 are foldably connected to the front panel 16 along fold lines 33 and 35 respectively.

A hanging portion 36 is provided that provide a hang tab for positioning the assembled package on a hook or similar hanging device for display. The hanging portion 36 includes triangular openings 37. The hanging portion 36 folds over along a fold line 38 for added support when assembled (see, FIGS. 17, 19, 23, and 26). Top end portion 40 includes a plurality of end flaps. The end portion 40 includes side top flaps 42*a* and 43*a* and a middle top flap 44. The first side top flap 42*a* includes a top slot 42*b* for receiving a first top tab 45*a* of the middle top flap 44 when in an assembled condition (see, FIGS. 17 and 23). The second side top flap 43*a* includes a top slot 43*b* for receiving a second top tab 45*b* of the middle top flap 44 when in an assembled configuration (see, FIGS. 18 and 24). Each of the hanging portion 36 and the top end portion 40 (side top flaps 42*a* and 43*a* and middle top flap 44) are foldably connected to one or more of the panels 12, 14, 16, and 18 along a fold line 47. The hanging portion 36 is foldably connected to the outer rear panel 12 along the fold line 47; the first side top flap 42*a* is foldably connected to the first side panel 14 along the 47; the middle top flap 44 is foldably connected to the front panel 16 along the fold line 47; and the second side top flap 43*a* is foldably connected to the second side panel 18 along the fold line 47.

Positioned opposite to the top end portion 40 at the end portions of the panels 12, 14, 16 18 is the bottom end portion 50. The bottom end portion 50 includes securing tab 52, side bottom flaps 54 and 55, and middle bottom flap 56. The securing tab 52 is positioned in the middle of a half-circular cutout 51 of an end portion 49 of the outer rear panel 12 and is foldably connected to the outer rear panel 12 along a fold line 53. The side bottom flaps 54 and 55 have a step profile and are positioned on either side of the middle bottom flap 56. The middle bottom flap 56 includes a bottom slot 57 for receiving at least a portion of the securing tab 52 when in an assembled configuration. The side bottom flaps 54 and 55 are positioned beneath the middle bottom flap 56 when in an assembled position.

The outer rear panel 12 includes the side tabs 60*a*, 60*b*, 60*c*, and 60*d*. The package and blank may contain any number of side tabs. In some embodiments, the package and blank includes at least one additional side tab and at least one additional slit and inner tab (see, FIG. 2). Each of the side tabs 60*a-d* are foldably connected to the outer rear panel 12 along fold lines 61*a*, 61*b*, 61*c*, and 61*d* respectively. Also included in the side tabs 60*a-d* are the side slots 62*a*, 62*b*, 62*c*, and 62*d* respectively. The side tabs 60*a-d* are received in slits 64*a*, 64*b*, 64*c*, and 64*d*, respectively, when the package and blank is in an assembled configuration (see, FIG. 18*b*). The slits

64*a-d* are formed in the second side panel 18 along the fold line 26. Inner tabs 66*a*, 66*b*, 66, and 66*d* are received in the side slots 62*a-d* when in an assembled configuration. The inner tabs 66*a-d* include half-circular partial cutouts 68*a*, 68*b*, 68*c*, and 68*d* positioned along the fold line 26. In this way, when the package and blank is an assembled configuration, the partial cutouts 68*a-d* extend out from the assembled package and assist the user in pulling the inner tabs 66*a-d* from the side slots 62*a-d* (see, FIGS. 18*a* and 20*a*).

As shown in FIG. 1, bracket grooves 72 and 74 are formed in inner rear panel 20. The bracket grooves receive a bracket 400 as described in more detail below with respect to FIG. 10.

Figure 4:
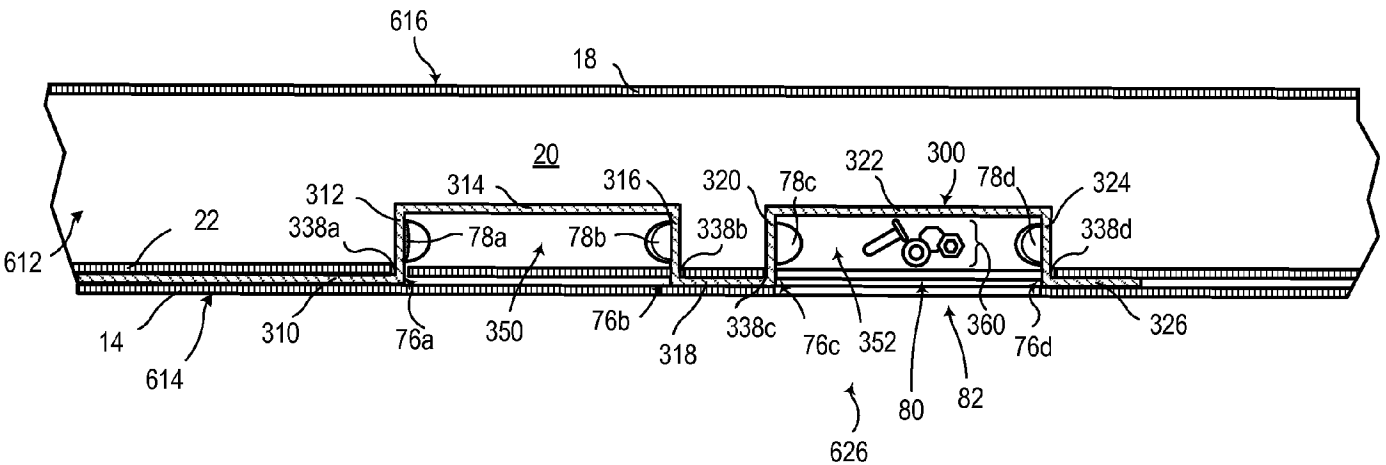
FIG. 4 is a partial section view showing an embodiment of an assembled insert for use in an assembled package.

The insert panel 22 includes insert grooves 76*a*, 76*b*, 76*c*, and 76*d* for receiving an insert 300 as discussed in more detail with respect to FIG. 4. Insert tabs 78*a*, 78*b*, 78*c*, and 78*d* formed in the inner rear panel 20 can be positioned within an area of the insert as discussed below with regard to FIG. 4. Also included in the insert panel 22 is a second side cutout 80. When in an assembled position, the second side cutout 80 aligns with a first side cutout 82 formed in the first side panel 14 (see, FIGS. 17 and 23).

FIG. 2 a blank 100 suitable for forming the package shown in FIGS. 23-27 is shown. The blank 100 is substantially similar to the package and blank 10 described above, where like reference numerals identify like components previously described to FIG. 1. The blank 100 further includes a foldable wall portion 556, and the partial cutouts 112, 114, 116, and 118 (described in more detail with regard to FIGS. 20*a* and 20*b*). Each of the partial cutouts 112, 114, 116, and 118 is formed in a portion of the second side panel 18 and a portion of the inner rear panel 20. The first partial cutout 112 includes a first wall 113*a* and a second wall 113*b*. Similarly, the second partial cutout 114 includes a first wall 115*a* and a second wall 115*b*; the third partial cutout 116 includes a first wall 117*a* and a second wall 117*b*; and the fourth partial cutout 118 includes a first wall 119*a* and a second wall 119*b*. The first and second walls of each of the partial cutouts 112, 114, 116, and 118 are foldably connected. The first wall of each of the partial cutouts 112, 114, 116, and 118 is positioned substantially perpendicular to the second side panel 18, and the second wall of each of the partial cutouts 112, 114, 116, and 118 is positioned substantially perpendicular to the inner rear panel 20 when the package and blank is in an assembled configuration. The first wall and the second wall of each of the partial cutouts 112, 114, 116, and 118 define a substantially square opening (see, FIG. 20*b*).

Figure 3:
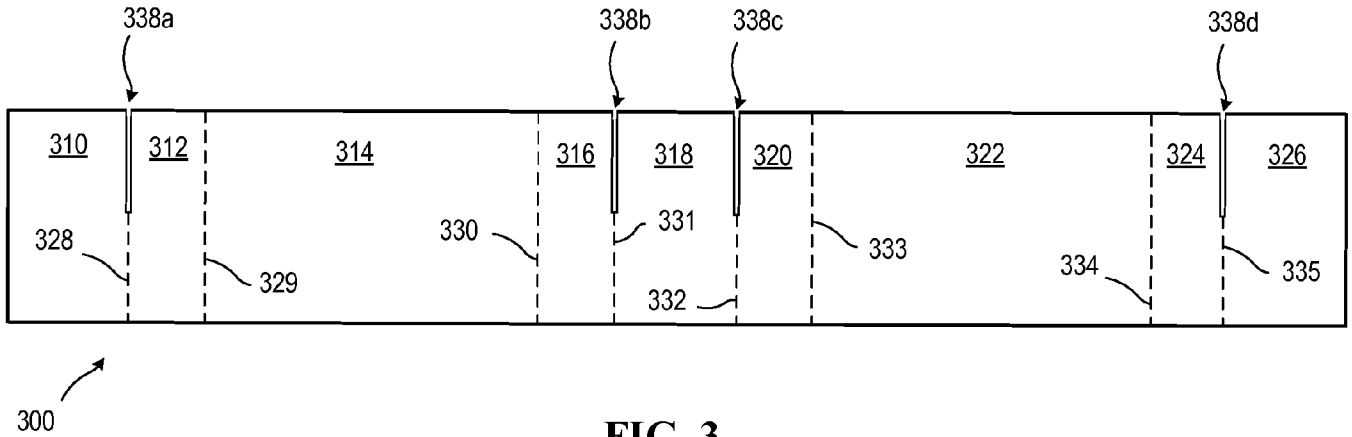
FIG. 3 is a plan view showing an embodiment of an insert for use in an assembled package.

FIGS. 3-4 illustrate an exemplary insert 300 for use in the package described herein. As shown in FIG. 3, the insert 300 includes a first end section 310, a first side section 312, a first front section 314, a second side section 316, a rear section 318, a third side section 320, a second front section 322, a fourth side section 324, and a second end section 326. The first end section 310 is foldably connected to the first side section 312 along a fold line 328; the first side section 312 is foldably connected to the first front section 314 along a fold line 329; the first front section 314 is foldably connected to the second side section 316 along a fold line 330, the second side section 316 is foldably connected to the rear section 318 along a fold line 331; the rear section 318 is foldably connected to the third side section 320 along a fold line 332; the third side section 320 is foldably connected to the second front portion 322 along a fold line 333; the second front section 322 is foldably connected to the fourth side section 324 along a fold line 334; and the fourth side section 324 is foldably connected to the second end section 326 along a fold line 335.

Insert gaps 338*a-d* are formed in the insert 300. The first insert gap 338*a* is positioned along the fold line 328, the second insert gap 338*b* is positioned along the fold line 331, a third insert gap 338*c* is positioned along the fold line 332, and the fourth insert gap 338*d* is positioned along the fold line 335. All of the insert gaps 338*a-d* are positioned substantially parallel to each other.

In FIG. 4, a partial section view illustrating an embodiment of the insert in an assembled configuration with a portion of the package 600 is shown. As illustrated, the insert panel 22 and the insert 300 are perpendicular to the inner rear panel 20. In the assembled configuration, the rear wall 612 of the package 600 includes the inner rear panel 20 and the second side wall 616 of the package 600 includes the second side panel 18. Also, the first side wall 614 of the package 600 includes the first side panel 14 and the insert panel 22. The first end section 310 is positioned beneath the insert panel 22 and at least a portion of the first side section 312 is positioned within the insert groove 76*a*. The front section 314 extends parallel to the insert panel 22 and at least a portion of the second side section 316 is positioned within the insert groove 76*b*. The rear section 318 is positioned beneath the insert panel 22 and the side section 318 is positioned within the insert groove 76*c*. The second front section 322 extends parallel to the insert panel 22 and at least a portion of the fourth side section 324 is positioned with the insert groove 76*d*. The second end panel 326 is positioned beneath the insert panel 22.

The insert 300 is positioned such that the insert gaps 338*a-d* are perpendicularly aligned with the insert grooves 76*a-d* to secure the insert 300 in an assembled configuration. Staples, tape, glue, and other securing mechanisms may be used to further secure the insert 300 to the insert panel 22. Positioned within a first storage area 350 defined by the sections 312, 314, and 316, are the insert tabs 78*a*, 78*b*. Likewise, the insert tabs 78*c* and 78*d* are positioned within a second storage area 352 defined by sections 320, 322, and 324. Insert tabs 78*a-d* can be positioned such that they are perpendicular to the inner rear panel 20 in order to secure storage components 360 positioned in the storage areas 350 and 352. For example, the insert tabs 78*a-d* may be used as wedges positioned between the storage components 360 and the sections 320 and 324 of the second storage area 352, or the sections 312 and 316 of the first storage area 350. The storage components 360 may include brackets, instructions, screws, washer, nuts, and any other items that can be placed in the storage areas 350 and 352. In some embodiments, the storage components 360 are placed in a storage container such as a clear plastic bag. When the blank 10 is in an assembled configuration, the storage components 360 can be viewed through the window 626. As shown, the window 626 includes the first side cutout 82 substantially aligned with the second side cutout 80.

Figure 5:
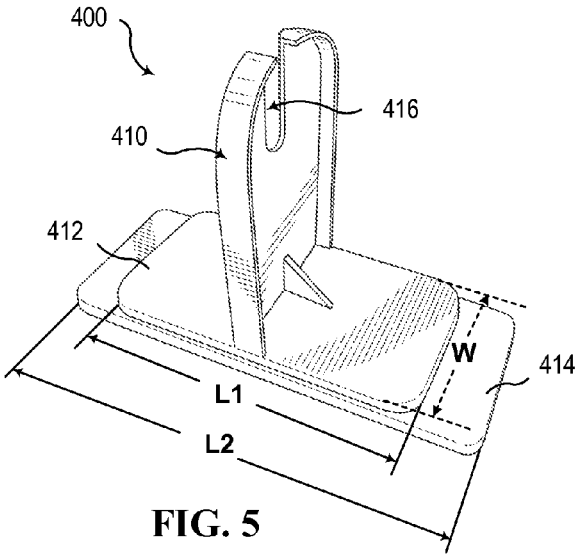
FIG. 5 is a perspective top view of an embodiment of a bracket for use in an assembled package.

FIGS. 5-10 illustrate an exemplary bracket 400 for use in the package described herein. The bracket 400 can be formed from plastics, metals, or other suitable materials. FIG. 5 is a perspective view of the bracket 400. The bracket 400 includes a clamping portion 410, a first plate 412, a second plate 414, and a bracket slot 416. The bracket slot 416 is formed in the clamping portion 410 and is U-shaped. The first plate is positioned beneath and is substantially perpendicular to the clamping portion 410. The second plate 414 is positioned beneath and substantially parallel to the first plate 412. As shown, the clamping portion 410 is attached to the top surface of the first plate 412.

Each of the first plate 412 and the second plate 414 has a substantially rectangular shape. The first plate 412 has a width W and a first length L1. The second plate has the width W and a second length L2. The length L1 may be, for example, equal to, less than, or greater than the length L2. As shown, the length L1 of the first plate 412 is less than the length L2 of the second plate 414. Further, the width W may be adjusted. For example, the width W may be increased or the length L1 or L2 may be increased such that the first plate 412 or second plate 414 have a wider area (first plate 412 area=W×L1 and second plate area=W×L2) for supporting an article positioned in the bracket slot 416.

Figure 6:
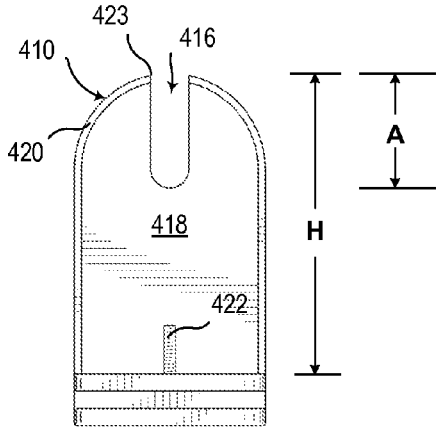
FIG. 6 is a front view of the bracket of FIG. 5.
Figure 7:
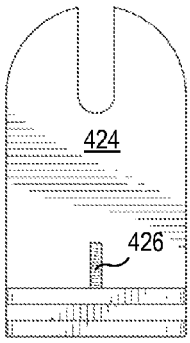
FIG. 7 is a rear view of the bracket of FIG. 5.

FIG. 6 illustrates a front view of the bracket 400. The clamping portion 410 includes a front face 418, an outer rim 420, and a front projection 422. As shown, the front face 418 has a half-oval shape and the outer rim 420 extends along at least a portion of the perimeter of the front face 418. The clamping portion 410 has a height H extending from the top surface of the first plate 412 to an edge 423. In the illustrated embodiment, the bracket slot 416 is open at one end and extends from the edge 423 for a distance A in the clamping portion 410. The distance A may be a fraction of the height H of the clamping portion 410. For example, the distance A may be from about $\frac{1}{4}^{th}$ of the height H to about $\frac{3}{4}^{th}$ of the height H. FIG. 7 illustrates a rear view of the bracket 400. The clamping portion 410 includes a rear face 424, and a rear projection 426.

Figure 8:
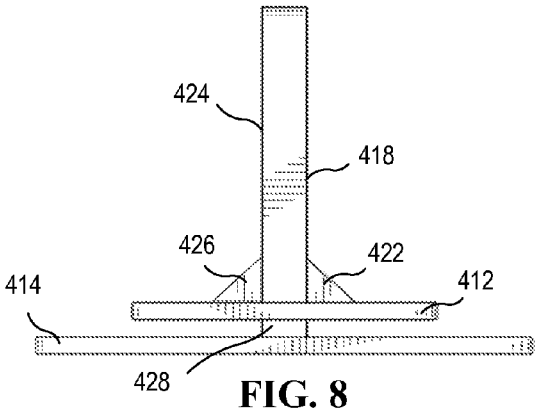
FIG. 8 is a side view of the bracket of FIG. 5.
Figure 9:
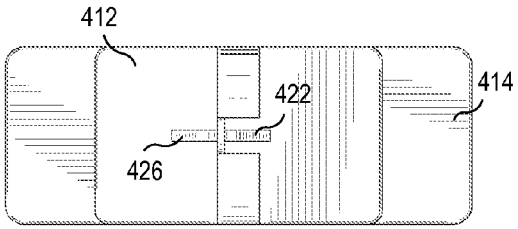
FIG. 9. is a top view of the bracket of FIG. 5.

FIG. 8 shows a side view and FIG. 9 shows a top view of the bracket 400. In the illustrated embodiment, the front projection 422 is attached to at least a portion of the surface of the front face 418 and to at least a portion of the top surface of the first plate 412. The rear projection 426 is attached to at least a portion of the surface of the rear face 424 and at least a portion of the top surface of the first plate 412. The projections 422 and 426 provide reinforcing support for the bracket 400. A linking portion 428 is positioned between the first plate 412 and the second plate 414. As shown, the linking portion 428 is attached to the bottom surface of the first plate 412 and the top surface of the second plate 414. The linking portion 428 extends along the entire width W of the first plate 412 and second plate 414.

Figure 10:
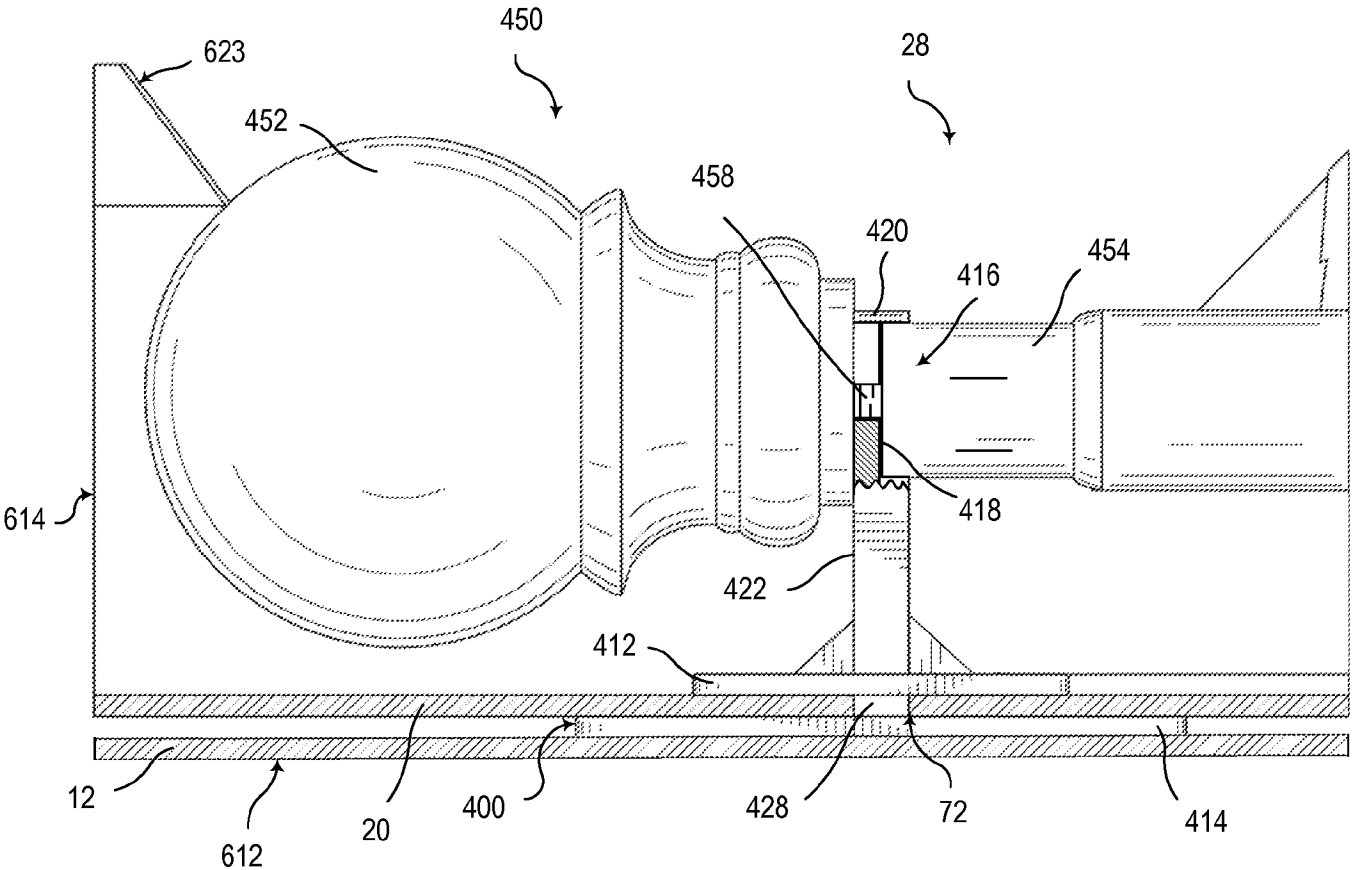
FIG. 10 is a partially cut-away section side view illustrating an embodiment of a bracket and a portion of an assembled package.

FIG. 10 illustrates a partially cut-away section side view of the bracket 400 in an assembled configuration. As shown, the bracket 400 can be used to secure the elongated member 450. The elongated member 450 may include, for example, window hardware such as a curtain rod or any other article. The elongated member 450 includes a first member 452 and a second member 454. The first member 452 may include, for example, a finial and the second member 454 may include a rod.

The bracket 400 is positioned such that the linking portion 428 is positioned within the bracket groove 72. It will be understood that a bracket identical to bracket 400 can also be positioned in the bracket groove 74. The bracket 400 is secured to the rear wall 612. The second plate 414 is positioned adjacent to and substantially parallel to the inner rear panel 20 and the first plate 412 is positioned adjacent to and substantially parallel to the inner rear panel 20. As shown, the first plate 412 is positioned above the inner rear panel 20 and the second plate 414 is position below the inner rear panel 20.

The bracket 400 is used to achieve a clamping effect to hold the elongated member 450. The bracket 400 is positioned such that the front face 418 abuts the second member 454 and the rear face 424 abuts the first member 452 of the elongated member 450. The elongated member 450 also includes a connecting member 458 for connecting or disconnecting the first member 452 and the second member 454. The connecting member 458 is a threaded screw that allows the first member 452 to be tightly secured to the second member 454. The connecting member 458 may be permanently affixed to the first member 452 or the second member 454. In one embodiment, the first member 452 can be at least partially disconnected from the second member 454 and the front face 418 of the bracket 400 can be placed in contact with the second member 454 such that the connecting member 458 is positioned within the bracket slot 416. The first member 452 can be reconnected to the second member over the rear face 424 and tightened to the bracket 400. In other exemplary embodiments, the second member 454 can be positioned within the bracket slot 416 without disconnecting portions of the elongated member 450. For example, the elongated member 450 can be pushed into the bracket slot 416. The outer rim 420 extending along the perimeter of the front face 418 further secures the elongated member 450 by preventing displacement of the second member 454. For example, the outer rim 420 prevents the second member 454 from sliding out of place in the event that the first member 452 becomes partially or fully disengaged from the connecting member 458.

Figure 11:
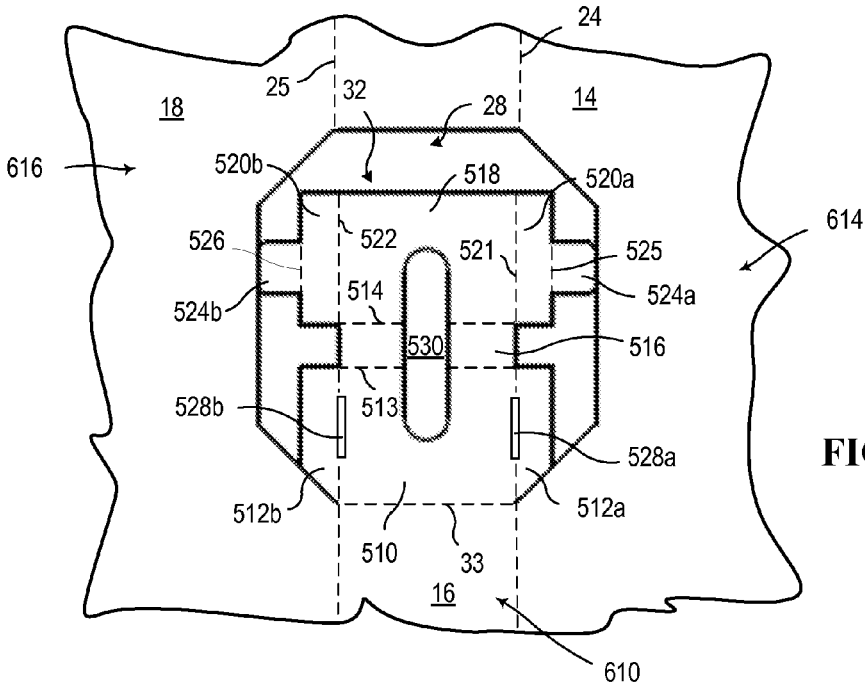
FIG. 11 is a top view of a portion of the package blank of FIG. 1.

FIGS. 11-16 show embodiments of isolating members 624 formed of foldable wall portions 32, 532, 556, and 580. It will be understood that the foldable wall portions 32, 532, 556, and 580 may be used in any one of the packages 600 or 645 and blanks 10 or 100. FIG. 11 is a portion of the package and blank 10 in FIG. 1 showing the foldable wall portion 32. The foldable wall portion 32 includes a lower wall panel 510, a middle wall panel 516, and an upper wall panel 518. The lower wall panel 510 is foldably connected to the front panel 16 along the fold line 33 (see, FIG. 1). The middle wall panel 516 is foldably connected to the lower wall panel 510 along a fold line 513 and the upper wall panel 518 is foldably connected to the middle wall panel 516 along a fold line 514.

A first flange **512*a* is foldably connected to the lower panel 510 at opposite side of the lower panel 510 along a fold line 521. A second flange 512*b* is foldably connected to the lower panel 510 along a fold line 522. A third flange 520*a* is foldably connected to the upper panel 518 along the fold line 521 and a fourth flange 520*b* is foldably connected to the upper panel 518 along the fold line 522. When in an assembled configuration, the flanges 512*a* and 520*a* fold down along the fold line 521 and the flanges 512*b* and 520*b* fold down along the fold line 522 such that the flanges are substantially perpendicular to the upper panel 518 and the lower panel 510. A first foldable tab 524*a* is foldably connected to the third flange 520*a* along a fold line 525 and a second foldable tab 524*b* is foldably connected to the fourth flange 520*b* along a fold line 526. The tabs 524*a*, 524*b* are received in the slots 528*a*, 528*b* of the lower panel 510** when in an assembled configuration.

An opening 530 is formed in at least a portion of the lower wall panel 510, the middle wall panel 516, and the upper wall pane 518. In the illustrated embodiment, the opening 530 is rod-shaped. The opening 530 secures objects with a curved surface such as a curtain rod when the panels 510, 514, 516 are folded over along the fold lines 513, 514 in an assembled configuration (see, FIG. 17). It will be understood that the opening 524 may be formed in any shape to accommodate a wide range of objects.

It will be further understood that the foldable wall portion can be formed in any shape. For example, in FIG. 12, a second embodiment of a foldable wall portion is illustrated at 532. The foldable wall portion 532 may be foldably connected to a front wall panel (not shown), such as the front wall panel 16 in FIGS. 1-2 along a fold line 535. The foldable wall portion 532 includes a lower wall panel 534, a middle wall panel 540, and an upper wall panel 542. The lower wall panel 534 is foldably connected to the middle wall panel 540 along a fold line 537 and the middle wall panel 540 is foldably connected to the upper wall panel 542 along a fold line 538. The fold lines 537, 538 are substantially parallel to each other and to the fold line 535.

The lower wall panel 534 includes flanges 536*a*, 536*b* and the upper wall panel 542 includes flanges 544*a*, 544*b*. Although the flanges 544*a*, 544*b* are illustrated as trapezoidal in shape, they may be formed in any shape. The first flange 536*a* is foldably connected to the lower wall panel 534 along a fold line 545 and the third flange 544*a* is foldably connected to the upper wall panel 542 along the fold line 545. Similarly, the second flange 536*b* is foldably connected to the lower wall panel 534 along a fold line 546 and the fourth flange 544*b* is foldably connected to the upper wall panel 542 along the fold line 546. Folding tabs 548*a*, 548*b* are foldably connected to the flanges 544*a*, 544*b*, along fold lines 549, 550, respectively. The fold lines 545, 546 are substantially parallel to the fold lines 549, 550. The fold lines 545, 546 and 549, 550 are substantially perpendicular to the fold lines 537, 538, and 535. An opening 554 is formed in at least a portion of the lower wall panel 534, the middle wall panel 540, and the upper wall panel 542.

Figure 13:
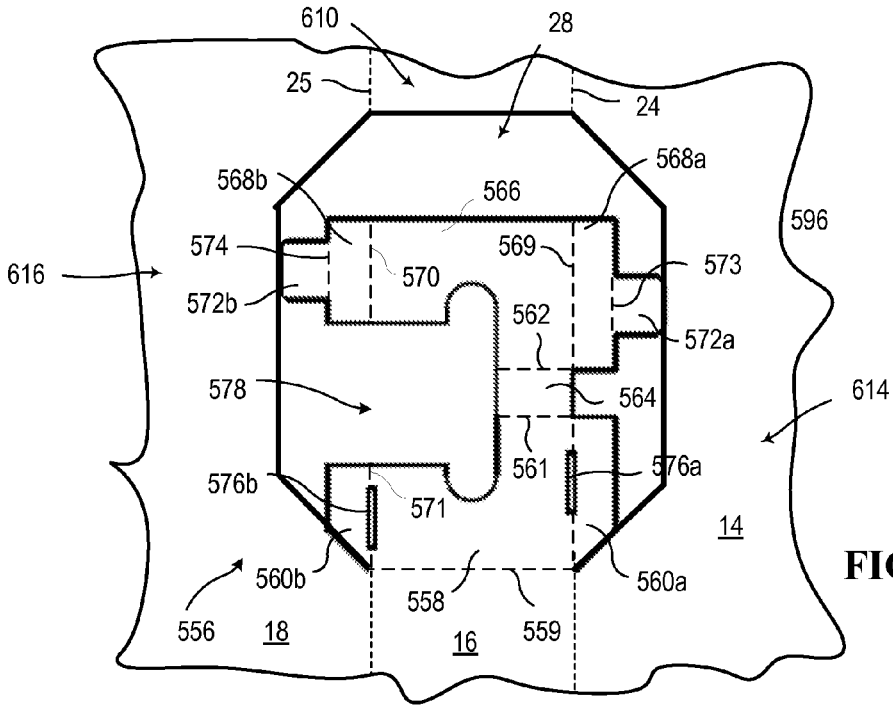

In FIG. 13, a third embodiment of a foldable wall portion is illustrated at 556. The foldable wall portion 556 may be foldably connected to a front wall panel (not shown) along a fold line 559 and may be positioned within a window opening (e.g., cutout portion 28, FIG. 1). The foldable wall portion 556 includes a lower wall panel 558, a middle wall panel 564, and an upper wall panel 566. The lower wall panel 558 is foldably connected to the middle wall panel 564 along a fold line 561 and the middle wall panel 564 is foldably connected to the upper wall panel 566 along a fold line 562. The fold lines 561, 562 are parallel to each other and to fold line 559.

The lower wall panel 558 includes flanges 560*a*, 560*b* and the upper wall panel 566 includes flanges 568*a*, 568*b*. The first flange 560*a* is foldably connected to the lower wall panel 558 along a fold line 569 and the third flange 568*a* is foldably connected to the upper wall panel 566 along the fold line 569. Similarly, the second flange 560*b* is foldably connected to the lower wall panel 558 along a fold line 571 and the fourth flange 568*b* is foldably connected to the upper wall panel 566 along a fold line 570.

Folding tabs 572*a*, 572*b* are foldably connected to the flanges 568*a*, 568*b*, along fold lines 573, 574, respectively. The folding tabs 572*a*, 572*b* are parallel to one another and are positioned in a staggered fashion. Slots 576*a*, 576*b* receive the folding tabs 572*a*, 572*b* respectively and the slots 576*a*, 576*b* are also parallel and staggered. The fold lines 569, 570, 571 are substantially parallel to the fold lines 573, 574. The fold lines 569, 570, 571, and 573, 574 are substantially perpendicular to the fold lines 559, 561, and 562.

Figure 12:
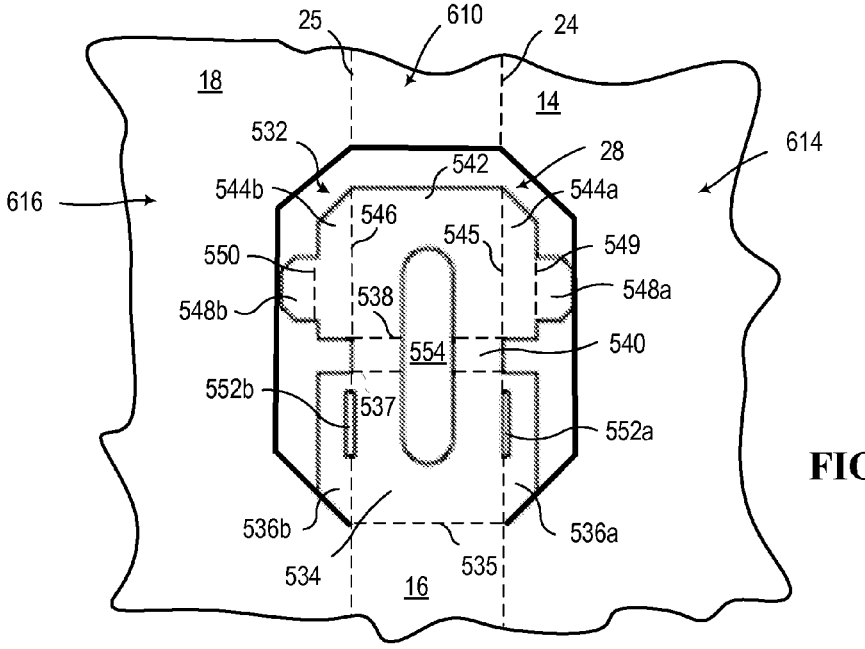
FIGS. 12-14 are top views illustrating an embodiments of a foldable wall portion.
Figure 14:
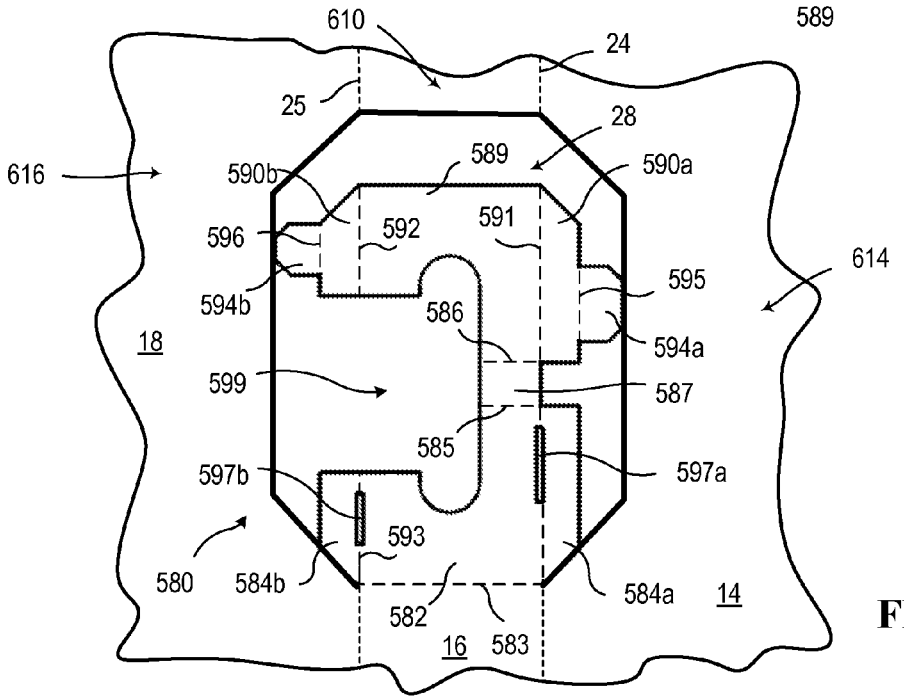

An opening 578 is formed in at least a portion of the lower wall panel 558 and the upper wall panel 566. Unlike the foldable wall portions 32 and 532 described above, the opening 578 of the foldable wall portion 556 is not formed in at least a portion of the middle wall panel 564. In FIGS. 11-12, at least a portion of the middle wall panel is positioned on either side of the opening. As illustrated in FIG. 4, the middle wall panel 564 is positioned on one side of the opening 578. In this way, the foldable wall portion 556 has a general C- or backward C-shape FIG. 14 illustrates a fourth embodiment of a foldable wall portion at 580. The foldable wall portion 580 includes a lower wall panel 582, a middle wall panel 587, and an upper wall panel 589. The lower wall portion 582 may be foldably connected to a front panel along a fold line 583. The lower wall panel 582 is foldably connected to the middle wall panel 587 along a fold line 585, and the middle wall panel 587 is foldably connected to the upper wall panel 589 along a fold line 586. The fold lines 585, 586 are parallel to the fold line 583.

Flanges 584*a*, 584*b* are foldably connected to the lower wall panel 582 along fold lines 591, 593 respectively. Similarly, flanges 590*a*, 590*b* are foldably connected to the upper wall panel 589 along fold lines 591, 592 respectively. As shown, folding tabs 594*a*, 594*b* are foldably connected to flanges 590*a*, 590*b* along fold lines 595, 596 respectively. In the illustrated embodiment, the second folding tab 590*b* is smaller in size than the first folding tab 594*a*. The folding tabs 594*a*, 594*b* are positioned parallel to each other in a staggered fashion. Slots 597*a*, 597*b* formed in the lower wall panel 582 receive the folding tabs 594*a*, 594*b* and are also staggered and positioned in parallel. The second slot 597*b* is smaller in size than the first slot 597*a* to correspond with the sizes of the folding tabs 594*a*, 594*b*. An opening 599 is formed in at least a portion of the lower wall panel 582 and in at least a portion of the upper wall panel 589. Like the foldable wall portion 556 of FIG. 13, the middle wall portion 587 is positioned on one side of the opening 599.

Figure 15:
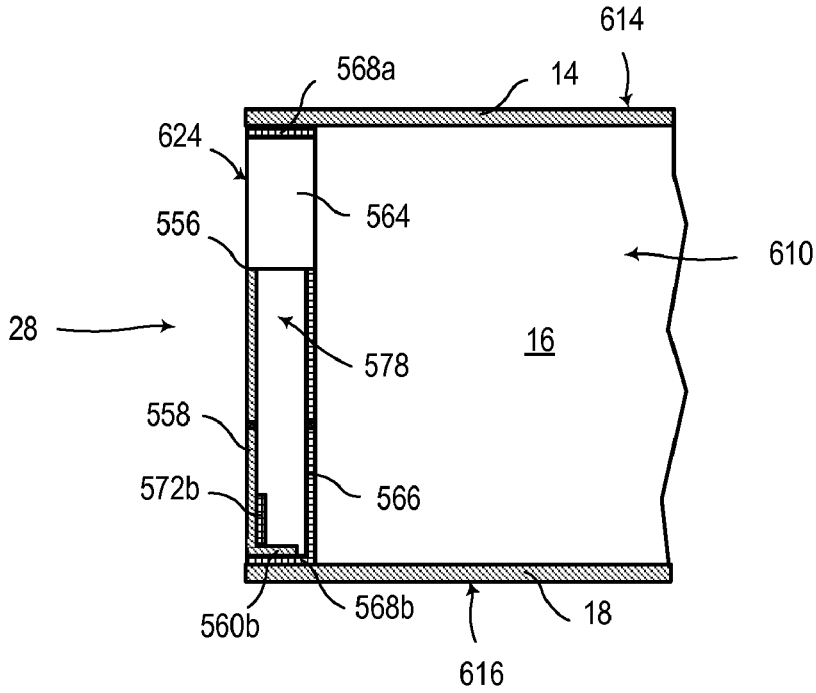
FIG. 15 is a top view illustrating an assembled foldable wall portion of FIG. 13.
Figure 16:
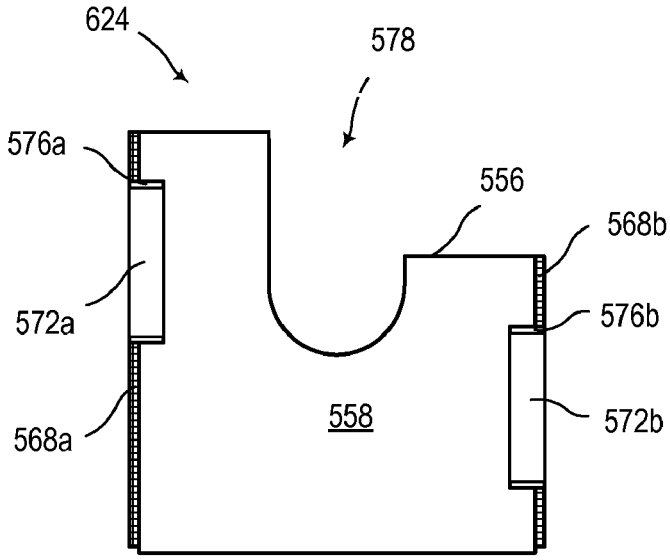
FIG. 16 is a front view illustrating an assembled foldable wall portion of FIG. 13.

FIGS. 15-16 illustrate the third embodiment of the foldable wall portion 556 in an assembled configuration. FIG. 15 shows a top section view of the foldable wall portion 556 and a portion of the package of the package 645. The isolating member 624 is positioned between the first side wall 614 and the second side wall 616. The lower wall panel 558 folds along the fold line 559 (not shown) such that the foldable wall portion 556 is perpendicular to the front panel 16. The second flange 560*b* folds along the fold line 571 (see, FIG. 13) and the fourth flange 568*b* folds over the second flange 560*b* along the fold line 570 (see, FIG. 13). Similarly, the first flange 560*a* (see, FIG. 13) folds along the fold line 569 (see, FIG. 13) and the third flange 568*a* folds over the first flange 560 along the fold line 569. As shown, the lower wall panel 558 can be viewed from the cutout 28 when in an assembled configuration (see, e.g., FIGS. 23 and 24). The middle wall panel 564 folds over along the fold lines 561, 562 such that it is one side of the opening 578.

In FIG. 16, a front view of the assembled foldable wall portion 556 is illustrated. The tabs 572*a*, 572*b* fold over along the fold lines 573, 574 (see, FIG. 13) and are received in the slots 576*a*, 576*b*, respectively. The first tab 572*a* is positioned higher than the second tab 572*b* in a staggered configuration. The opening 578 shortens one side of the lower wall panel 558 such that a third member 456 of the elongated member 450 can be viewed from the window cutout portion 28 (see, e.g., FIGS. 23 and 24).

Figure 17:
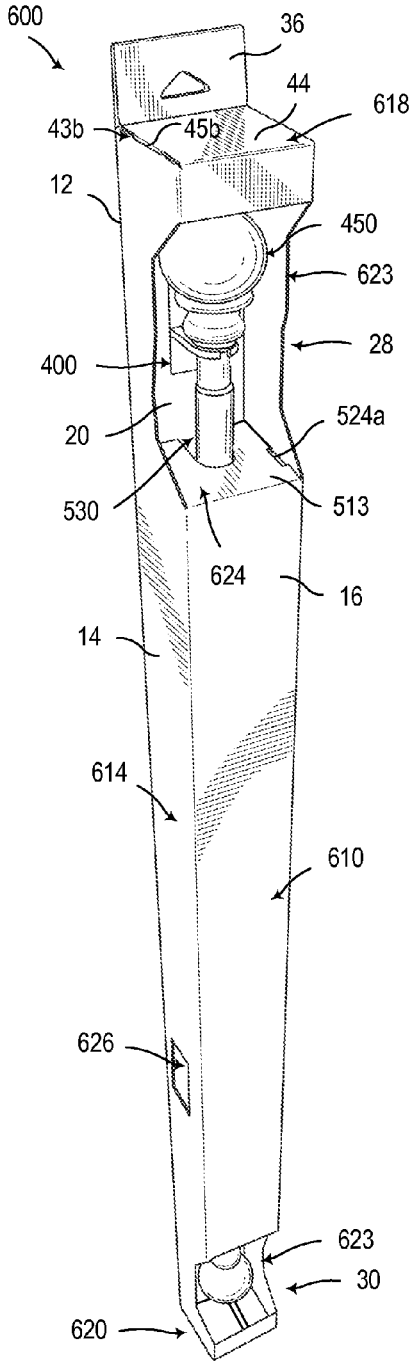
FIGS. 17 and 18 are perspective views illustrating embodiments of an assembled package.
Figure 18:
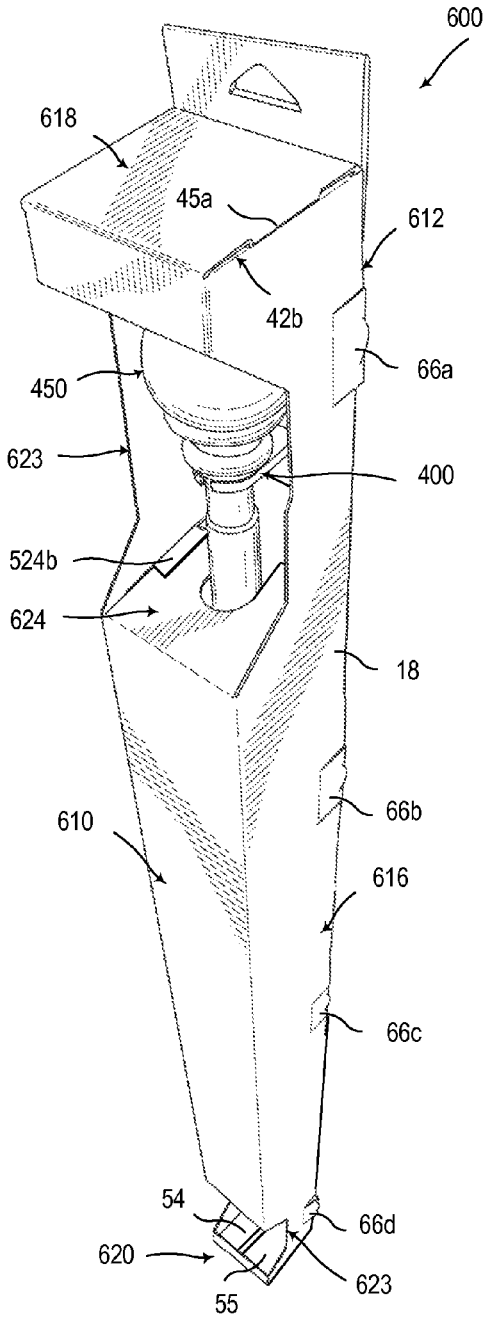
Figure 19:
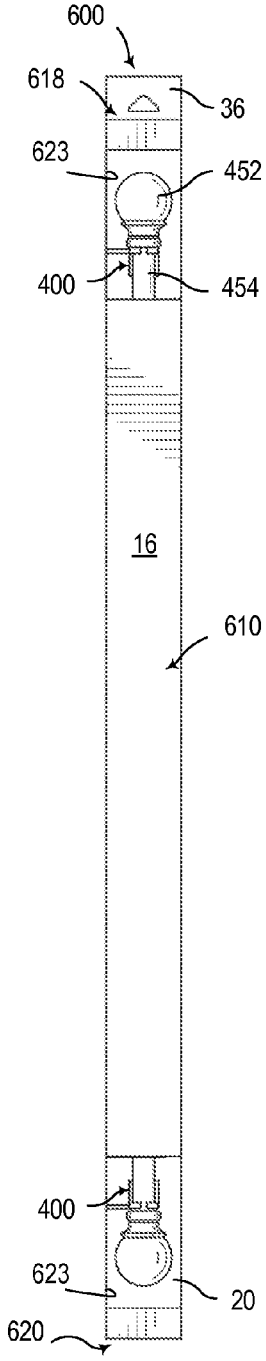
FIG. 19 is a front view illustrating an embodiment of an assembled package.
Figure 20:
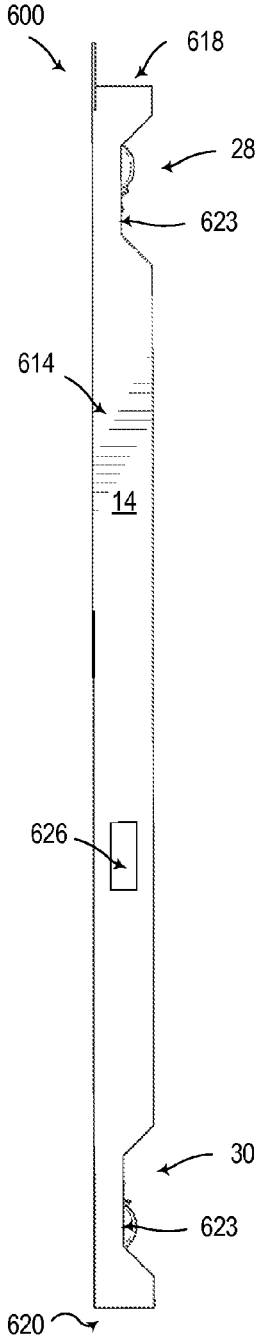
FIG. 20 is a side view illustrating an embodiment of an assembled package.
Figure 21:
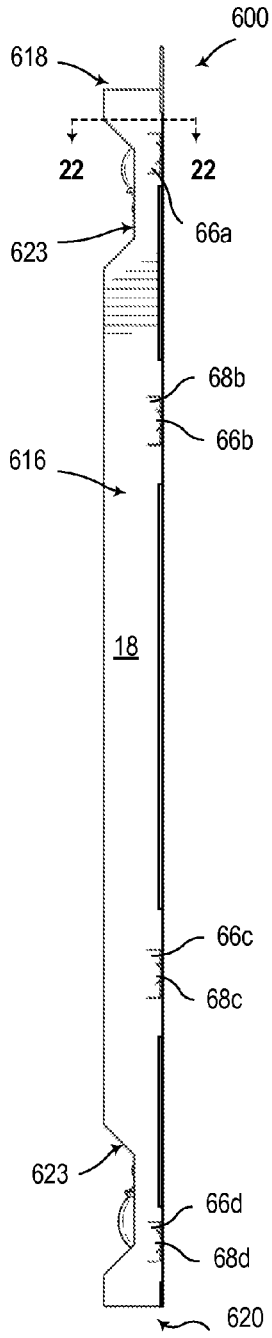
FIG. 21 is another side view illustrating an embodiment of an assembled package.

FIGS. 17-21 illustrate embodiments of the assembled package 600 described herein. FIGS. 17-18 illustrate perspective views of the assembled package 600 formed from the package and blank 10. The window 626 is formed in the first side wall 614 and allows a user to see the storage components 360 positioned in the storage area 352 (see, FIG. 4). Although the illustrated embodiments show a package for curtain rods, it will be understood that the package detailed and described herein may be used to package and display any item. FIG. 19 illustrates a front view of the package 600 and FIGS. 20-21 illustrate side views of the package 600.

Figure 22:
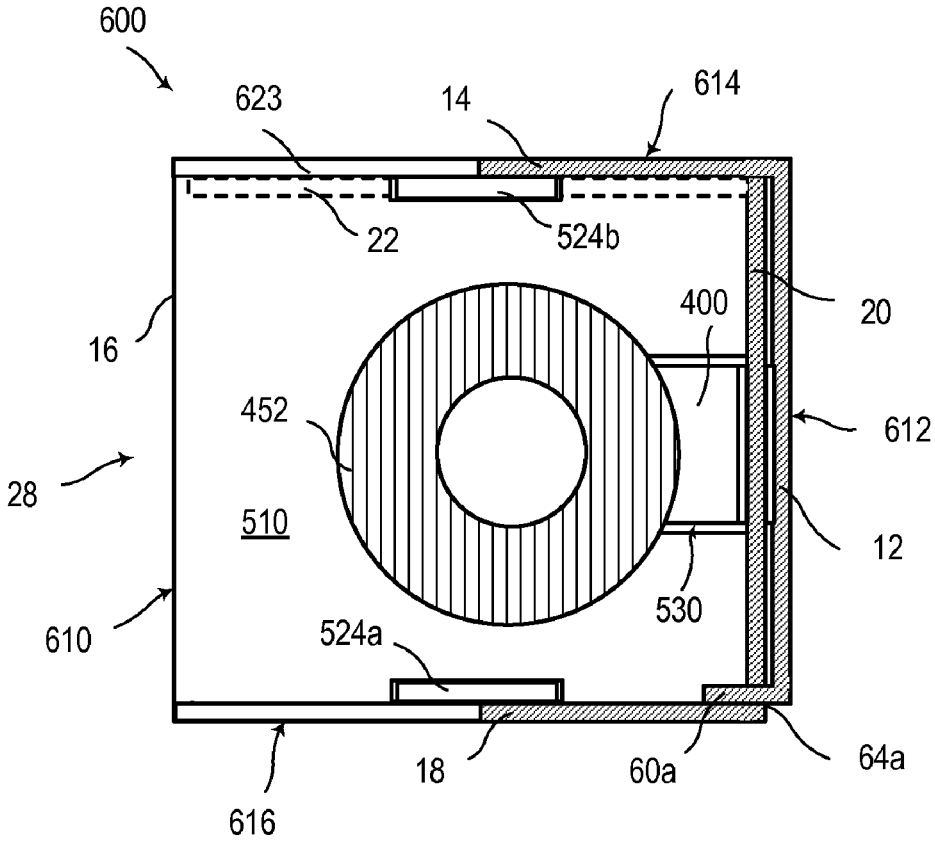
FIG. 22 is a section view of an embodiment of an assembled package taken along the line 22-22 of FIG. 21.
Figure 23:
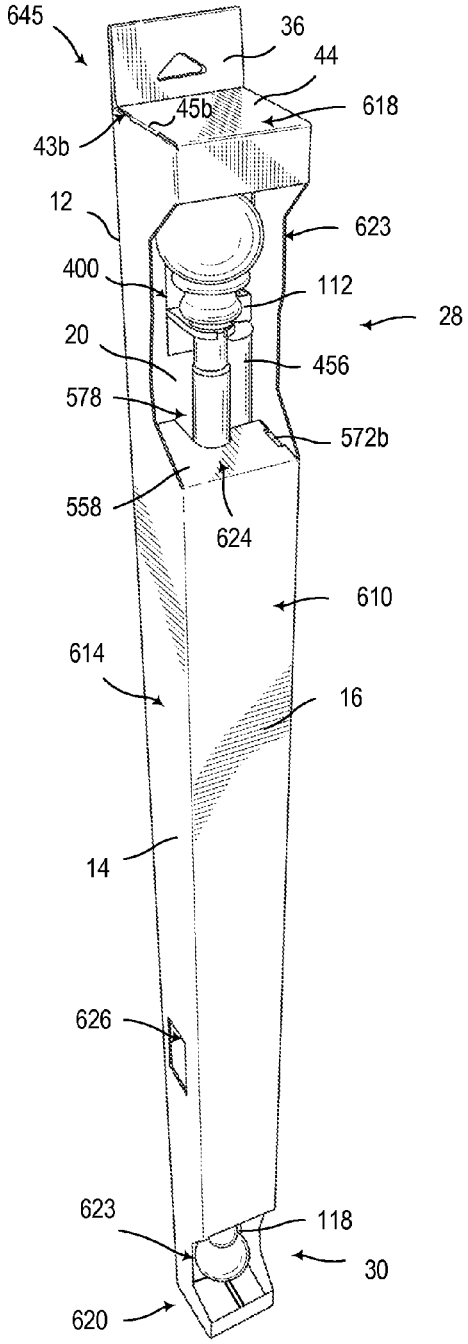
FIGS. 23 and 24 are perspective views illustrating another embodiment of an assembled package.
Figure 24:
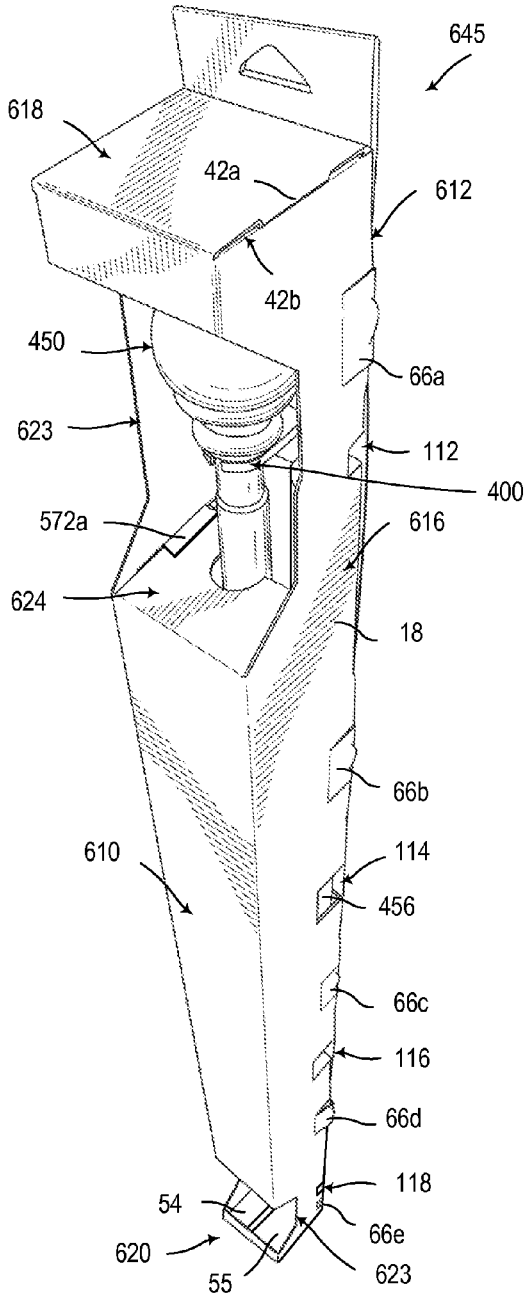
Figure 25:
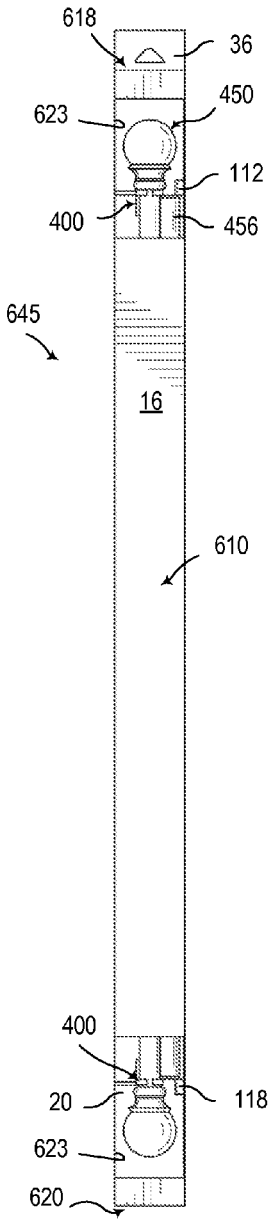
FIG. 25 is a front view illustrating another embodiment of an assembled package.
Figure 26:
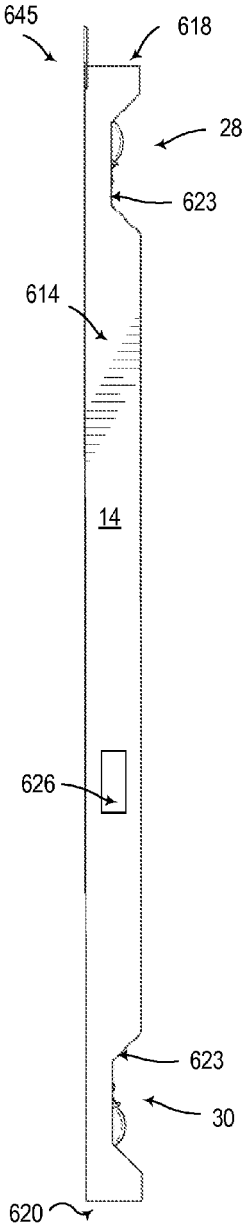
FIG. 26 is a side view illustrating another embodiment of an assembled package.

FIG. 22 is a section view of the package 600 in FIG. 21 taken along line 22-22. The package 600 includes the outer rear panel 12 that includes one or more of the side tabs 60*a-d*. In the illustrated embodiment, the side tab 60*a* is received in the slit 64*a* of the second side panel 18. The package also includes the front panel 16, which is connected to the outer rear panel 12 by the first side panel 14 and the second side panel 18. The inner rear panel 20 is connected to the second side panel 18 and positioned adjacent to and substantially parallel to at least a portion of the outer rear panel 12. The insert panel 22 is connected to the inner rear panel 20 and positioned adjacent to and substantially parallel to at least a portion of the first side panel 14. Positioned between the first side panel 14 and the insert panel 22 is the first end section 310 of the insert 300. The bracket 400 secures the first member 452 to the inner rear panel 20. Also shown are the lower panel 510 of the foldable wall portion 32 in assembled configuration and the folding tabs 524*a* and 524*b*. The lower panel 510 isolates a portion of the package 610 such that a user cannot view the entire elongated member 450 positioned in the package 610.

FIGS. 23-27 illustrate the assembled package 645 formed from the blank 100. In the illustrated embodiments, the package 645 is configured to accommodate a third member 456 of the elongated member 450. The partial cutout 112 folds inward and abuts the third member 456 to secure the third member 456. Likewise, the fourth partial cutout 118 also folds inward to secure the third member 456 at the opposite end. The opening 578 (see also, FIGS. 13 and 16) of the foldable wall portion 556 is configured to accommodate the third member 456 such that the third member 456 can be viewed from the window cutout portion 28 (see also, FIG. 28). The partial cutouts 114 and 116 fold inward to form a square opening for receiving the second rod portion 456. In this way, the second rod portion can be viewed from the side of the package. The partial cutouts 114, 116 also help to further secure the rod portion 456 by preventing the third member 456 from moving out of position.

Figure 27:
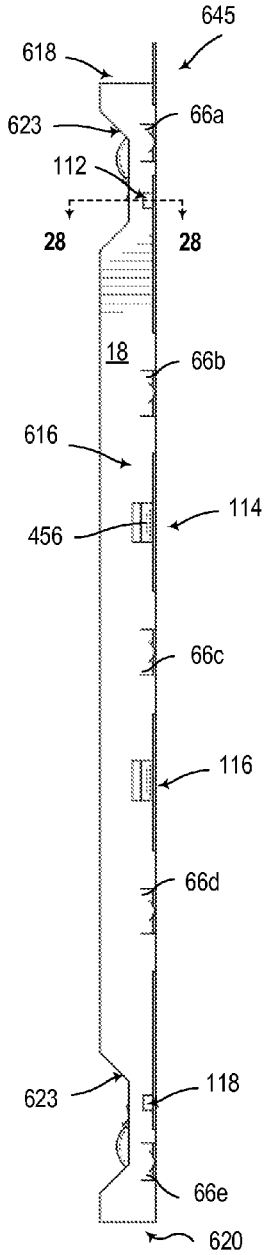
FIG. 27 is another side view illustrating another embodiment of an assembled package.
Figure 28:
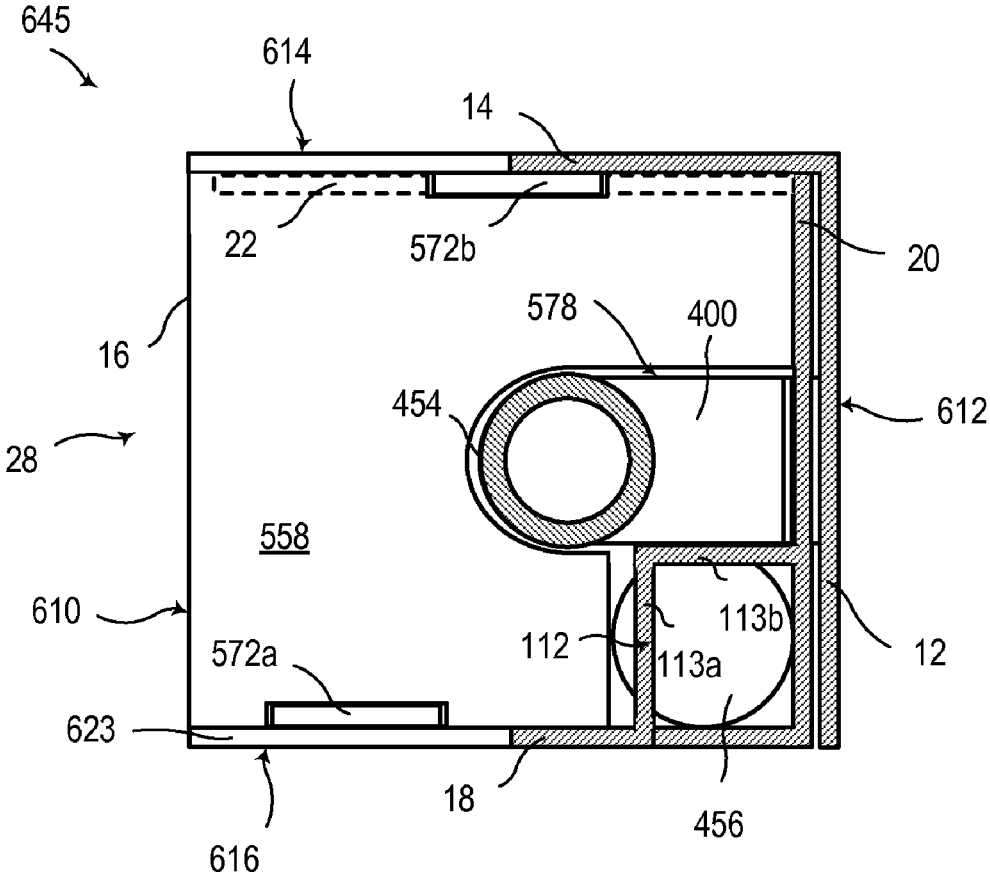
FIG. 28 is a section view of the assembled package taken along the line 28-28 of FIG. 27.

FIG. 28 is a section view of the package 645 in FIG. 27 taken along line 28-28. The first end section 310 of the insert 300 is positioned behind the insert panel 22 and at least a portion of the first side section 312 is positioned in the insert groove 76*a* (see, FIG. 4). The insert panel 22 folds and connects to the inner rear panel 20. In some embodiments, the insert panel 22 is positioned adjacent to and substantially parallel to at least a portion of the first side panel 14. The inner rear panel folds and connects to the second side panel 18, which folds and connects to the front panel 16. In the illustrated embodiment, the inner rear panel 20 is positioned adjacent to and substantially parallel to at least a portion of the outer rear panel 12. The front panel 16 folds and connects to the first side panel 14 and the first side panel 14 folds and connects to the outer rear panel 12. The second member 454 is positioned in the opening 278 formed in the lower wall panel 558. The partial cutout 112 folds inward to form a square opening. The first wall 113*a* of the partial cutout 112 is positioned substantially perpendicular to the second side panel 18 (see also, FIG. 25) and the second wall 113*b* is positioned substantially perpendicular to the inner rear panel 20. The partial cutout 112 abuts the third member 456 and holds the third member 456 in place.

To assemble the package 610 or the package 645, the foldable wall portions 32, 532, 556, 580 can be assembled as described above with respect to FIGS. 11-16. It will be understood that one or more foldable wall portions may be included in the assembled packages described herein. In some embodiments, one or more of the foldable wall portions 32, 532, 556, 580 may be disposed at the window cutout portions 28 and 30. The insert panel 22 is folded along the fold line 27 and the insert 300 is placed into the insert grooves 76*a-d* as described above with respect to FIG. 4. In some embodiments, the storage components 360 are placed in the storage areas 350 and/or 352. The brackets 400 are placed in the bracket grooves 72 and 74 and the elongated member 450 is placed in the brackets as described above with regard to FIG. 10. For the package 645, the partial cutouts 114 and 116 are created on folding panel 18 relative to panel 20 along fold line 26 such that cutout 114 and 116 extend into the package and the secondary elongated member 456 is placed in the square openings formed by the partial cutouts 114, 116. The second member 452 is positioned in the openings 530, 554, 578, or 599 formed in the respective assembled foldable wall portions 32, 532, 556, and 580 (see, e.g., FIGS. 11-16 and 17 and 23).

The inner rear panel 20 is folded along the fold line 26 and the second side panel 18 is folded along the fold line 25 to form the second side wall 616. The first side panel 14 is folded along the fold line 24 such that the first side panel 14 is adjacent to and substantially parallel to the insert panel 22. In this way, the first side wall 614 is formed. The outer rear panel 12 is folded along the fold line 23 such that the outer rear panel 12 is adjacent to and substantially parallel to the inner rear panel 20 to form the rear wall 612.

The side tabs 60*a-e* are placed into the slits 64*a-e* and the inner tabs 66*a-e* are placed into the side slots 62*a-e*. The bottoms side flaps 54 and 55 are folded and the middle bottom flap 56 is folded along the fold line 59 such that the side flaps 54 and 55 are positioned adjacent to and substantially parallel to the bottom middle flap 56. To form the bottom end 620, a portion of the bottom middle flap 56 is placed adjacent to and substantially parallel to the inner rear panel 20 to secure the bottom middle flap 56. And, the securing tab 56 is inserted into the slot 57 of the bottom middle flap 56.

To form the top end 618, the side top flaps 42*a*, and 43*a* and the middle top flap 44 are folded along the fold line 47. A portion of the middle top flap 44 is positioned adjacent to and substantially parallel to the inner rear panel 20. The tabs 45*a* and 45*b* of the middle top flap 44 are placed in the slots 42*b* and 42*a*, respectively. Further, the hanging portion 36 is folded along the fold line 38 such that the hanging portion 35 is adjacent and substantially parallel to the middle top flap 44. It will be understood that the assembly of the package and blank described herein may be performed in any order.

Specific embodiments of an invention are described herein. One of ordinary skill in the art will recognize that the invention has other applications in other environments. In fact, many embodiments and implementations are possible. The following claims are in no way intended to limit the scope of the invention to the specific embodiments described above.

The invention claimed is:

1. A package comprising:

a rear wall;

a front wall connected to the rear wall by a first side wall and a second side wall;

a first end portion disposed at a first end of the rear wall, the front wall, the first side wall and the second side wall and a second end portion disposed at an opposing second end of the rear wall, the front wall, the first side wall, and the second side wall; and an elongated member comprising a first member connected to a second member by a connecting member such that the first member is movable toward and away from the second member;

at least one bracket for holding the elongated member by a clamping effect;

wherein the clamping effect comprises positioning the at least one bracket between the first member and the second member and moving the first member toward the second member via the connecting member.

2. The package of claim 1, wherein each of the at least one bracket comprises a clamping portion having a bracket slot formed therein.

3. The package of claim 2, wherein the clamping effect comprises positioning the connecting member within the bracket slot.

4. The package of claim 1, wherein each of the at least one bracket further comprises a front face and a rear face, and wherein the clamping effect comprises abutting the first member to the rear face and the abutting the second member to the front face.

5. The package of claim 4, wherein each of the at least one bracket Comprises an outer rim extending along the perimeter of the front face.

6. The package of claim 1, wherein the first side wall comprises an insert panel.

7. The package of claim 6, further comprising an insert, wherein the insert is received in an insert groove formed in the insert panel.

8. The package of claim 1, wherein the first side wall has a window formed therein.

9. The package of claim 1, further comprising a partial cutout formed in a portion of the second side wall and a portion of the rear wall, the partial cutout comprising a first wall and a second wall; wherein the first wall is substantially perpendicular to the second side wall and the second wall is substantially perpendicular to the rear wall, and wherein the first wall and the second wall define a substantially square opening.

10. The package of claim 9, wherein a third member of the elongated member is positioned within the square opening. comprises an outer rim extending along the perimeter of the front face.

11. The package of claim 1, wherein the first member comprises a finial and the second member comprises a rod.

12. A package comprising:

a rear wall comprising an outer rear panel and an inner rear panel;

a front wall connected to the rear wall by a first side wall and a second side wall;

a first end portion disposed at a first end of the rear wall, the front wall, the first side wall and the second side wall and a second end portion disposed at an opposing second end of the rear wall, the front wall, the first side wall, and the second side wall; and an elongated member comprising a first member connected to a second member by a connecting member such that the first member is movable toward and away from the second member;

at least one bracket for holding the elongated member by a clamping effect;

wherein the at least one bracket further comprises:

a first plate disposed beneath a clamping portion;

a second plate disposed beneath the first plate; and a linking portion positioned between the first plate and the second plate;

wherein the linking portion is positioned within a bracket groove formed in the inner rear panel and wherein each of the first plate and second plate is positioned substantially parallel and adjacent to the inner rear panel.

13. The package of claim 12, wherein the first member comprises a finial and the second member comprises a rod.

14. A package comprising:

a rear wall comprising an outer rear panel and an inner rear panel;

a front wall connected to the rear wall by a first side wall and a second side wall;

a first end portion disposed at a first end of the rear wall, the front wall, the first side wall and the second side wall and a second end portion disposed at an opposing second end of the rear wall, the front wall, the first side wall, and the second side wall; and an elongated member comprising a first member connected to a second member by a connecting member such that the first member is movable toward and away from the second member;

at least one bracket for holding the elongated member by a clamping effect; and a foldable wall portion, the wall portion comprising:

a lower wall panel connected to and substantially perpendicular a portion of the front wall;

a middle wall panel connected to and substantially perpendicular to the lower wall panel; and an upper wall panel connected to the middle wall panel and substantially parallel to the lower wall panel.

15. The package of claim 14, wherein at least a portion of the middle wall panel, the lower wall panel, and the upper wall panel have an opening formed therein.

16. The packaging of claim 14, wherein the at least a portion of the lower wall panel and upper wall panel have an opening formed therein, and wherein the middle wall panel is positioned on one side of the opening.

17. The package of claim 14, wherein a portion of the first side wall, the front wall, and the second side wall have a viewing window formed therein, and wherein the foldable wall portion is disposed at the viewing window.

18. The package of claim 14, wherein the first member comprises a finial and the second member comprises a rod.

19. A package blank comprising:

an outer rear panel;

a first side panel foldably connected to the outer rear panel;

a front panel foldably connected to the first side panel;

a second side panel foldably connected to the front panel, wherein at least a portion of the first side panel, the front panel, and the second side panel have a window cutout portion formed therein;

an inner rear panel foldably connected to the second side panel;

end flaps foldably connected to the outer rear panel, first side panel, front panel, and second side panel;

a bracket connected to the inner rear panel; and a foldable wall portion positioned within the window cutout portion, the wall portion comprising:

a lower wall panel foldably connected to a portion of the front panel;

a middle wall panel foldably connected to the lower wall panel; and an upper wall panel foldably connected to the middle wall panel.

20. The blank of claim 19, wherein at least a portion of the middle wall panel, the lower wall panel, and the upper wall panel have an opening formed therein.

21. The blank of claim 19, wherein at least a portion of the lower wall panel and the upper wall panel have an opening formed therein, and wherein the middle wall panel is positioned on one side of the opening.

22. The blank of claim 19, wherein the bracket is received in a bracket groove formed in the inner rear panel.

* * * * *

UNITED STATES PATENT AND TRADEMARK OFFICE

CERTIFICATE OF CORRECTION

PATENT NO. : 8,191,707 B2
APPLICATION NO. : 12/915627
DATED : June 5, 2012
INVENTOR(S) : Brian James McDonald and Tongchai Saesim It is certified that error appears in the above-identified patent and that said Letters Patent is hereby corrected as shown below:

Column 13, lines 29-30, remove "comprises an outer rim extending along the perimeter of the front face."

Signed and Sealed this
Twenty-eighth Day of August, 2012

David J. Kappos

David J. Kappos
*Director of the United States Patent and Trademark Office*